US008424361B1

(12) United States Patent
Evans

(10) Patent No.: US 8,424,361 B1
(45) Date of Patent: Apr. 23, 2013

(54) PITTSBURGH LOCK OPENING TOOL

(75) Inventor: Robert Evans, Springbrook Township, PA (US)

(73) Assignee: Precision Sheet Metal, Scott Township, PA (US)

( * ) Notice: Subject to any disclaimer, the term of this patent is extended or adjusted under 35 U.S.C. 154(b) by 0 days.

(21) Appl. No.: 13/355,693

(22) Filed: Jan. 23, 2012

Related U.S. Application Data

(60) Provisional application No. 61/434,917, filed on Jan. 21, 2011.

(51) Int. Cl.
*B21D 3/10* (2006.01)
*B21D 5/16* (2006.01)

(52) U.S. Cl.
USPC ..... 72/458; 72/479; 81/3.4

(58) Field of Classification Search ..... 72/457, 72/458, 459, 479; 81/3.34, 3.4
See application file for complete search history.

(56) References Cited

U.S. PATENT DOCUMENTS 1,286,488 A * 12/1918 Amberg ..... 72/458
1,879,583 A * 9/1932 Stowell ..... 72/458
2,159,784 A 5/1939 Demmin
2,576,000 A * 11/1951 Cowan, Jr. ..... 81/3.55
2,937,549 A * 5/1960 Shelby, Jr. ..... 72/458
3,872,745 A 3/1975 Garza et al.
4,034,595 A 7/1977 Smith
4,216,685 A * 8/1980 Taylor ..... 81/3.55
4,409,717 A * 10/1983 Boozer ..... 29/402.19
4,934,174 A 6/1990 Gronlund et al.
4,974,441 A 12/1990 Keeney et al.
5,095,735 A 3/1992 Schneider
5,394,729 A * 3/1995 Eisenhower, Jr. ..... 72/450
6,131,434 A 10/2000 Schneider
7,690,239 B2 * 4/2010 Griffis ..... 72/458

* cited by examiner

*Primary Examiner* — David B Jones
(74) *Attorney, Agent, or Firm* — Mark Levy; Hinman, Howard & Kattell, LLP

(57) ABSTRACT

A hand held Pittsburgh lock opening device is designed to open a longitudinal seam that is used in the fabrication of sheet metal ductwork. The tool has a unitary, longitudinal base having a major plane, an upper surface, and a lower surface. The base tapers from a proximal end to a distal end thereof. A plurality of parallel, longitudinal channels is oriented along the major plane on both upper and lower surfaces of the base. A protrusion is provided at the distal end of the base from its upper surface and extends from the upper surface of the base perpendicularly to the major plane thereof. The protrusion is tapered upwardly to an uppermost end and away from the base. An inverted U-shaped terminus is disposed at the uppermost end of the protrusion and forms a sharp taper for penetrating between coacting duct components.

16 Claims, 2 Drawing Sheets

PITTSBURGH LOCK OPENING TOOL

RELATED APPLICATIONS

This application is a Continuation-in-Part of Provisional U.S. Patent Application Ser. No. 61/434,917, filed Jan. 21, 2011 and claims priority thereto in accordance with 35 U.S.C. §1.78.

FIELD OF THE INVENTION

The present invention pertains to a hand held device for opening or uncrimping a longitudinal seam in sheet metal ductwork and, more particularly, to a device for opening a Pittsburgh lock.

BACKGROUND OF THE INVENTION

Metal ductwork is used in many commercial and residential structures for moving or distributing air in the course of heating, ventilating, and air conditioning. Sheet metal sections are connected together either at a factory or at a construction site. Such ductwork most often has a rectilinear (square or rectangular) or circular cross sectional shape. Often, a main run has at least one branch extending along a major axis and connected to sections at angles thereto.

Clinch collar tabs extend along an edge so that they can be bent or crimped to a component (e.g., another branch, an elbow connection, or other fitting) so that the components interconnect to form a completed duct. The clips of a component are squeezed, hammered, or otherwise forced to bend them relative to their related component.

The corner joints, called Pittsburgh joints or locks, sometimes must be disassembled for purposes of removal or replacement. Also, when assembling the sheet metal ductwork, a common, longitudinal seam must be slightly opened while assembling the joint. This seam can be difficult and inconvenient to open; conventional tools are often not sufficient. The time consuming process can diminish productivity and increase costs. A more efficient method is needed.

DISCUSSION OF THE RELATED ART

U.S. Pat. No. 2,159,784, issued May 23, 1939 to Demmin for APPARATUS FOR USE IN FORMING PITTSBURGH JOINTS, discloses an apparatus for forming Pittsburgh joints contemplating a special machine or an attachment to the well known brake employed in sheet metal bending operations.

U.S. Pat. No. 3,872,745, issued Mar. 25, 1975 to Garza, et al. for OPENER TOOL, discloses an opening tool for use with closures of a modified crown type. The hand operated one-piece tool is formed of flat stock and has a handle portion and an offset hooked end. The hooked end engages with a substantial portion (about 30 degrees) of the under edge of the closure while the junction of the hook and handle portions engages the top of the closure immediately adjacent the part engaged by the hooked portion.

U.S. Pat. No. 4,034,595, issued Jul. 12, 1977 to Smith for SHEET METAL WORKING TOOL, discloses a sheet metal working tool for turning an edge of sheet metal perpendicular to the main portion of the sheet metal and for opening Pittsburgh locks formed in said metal.

U.S. Pat. No. 4,934,174, issued Jun. 19, 1990 to Gronlund, et al. for SHEET METAL BENDING TOOL, discloses a sheet metal bending tool adapted for bending and repairing automotive sheet metal parts. The tool includes at least a shank and a hook end portion designed to facilitate holding and bending of sheet metal edges in a variety of applications. In a preferred embodiment, the tool also includes a "V" shaped inner surface specially adapted to grip metal pieces.

U.S. Pat. No. 4,974,441, issued Dec. 4, 1990 to Keeney, et al. for DUCTWORK CLIP UNCRIMPER, discloses a tool used for separating clinched together first and second components of a duct by the uncrimping of the clinch collar tab of the first component from the second component. The clinched parts are first pried loose by a sharpened point of a tool that is penetrated between the tab and the second component. The prying is continued by virtue of the use of the fulcrum, integral with the tool, so that the tab is moved from its initial 90 degree position to its subsequent zero degree position.

U.S. Pat. No. 5,095,735, issued Mar. 17, 1992 to Schneider, Jr. for PITTSBURGH LOCK HAMMER GUIDE, discloses a guide for removable attachment to a conventional pneumatic hammer. The hammer is used as a Pittsburgh lock hammer. The guide includes a hollow, open-ended tubular element that defines a fragmentary cylindrical wall, and an adjustable fastener is attached to the exterior surface of the wall for removably attaching the element to the pneumatic hammer.

U.S. Pat. No. 6,131,434, issued Oct. 17, 2000 to Schneider, Jr. for COMBINATION PNEUMATIC HAMMER, SPRING AND GUIDE FOR CHISELS IN USE FOR SEALING PITTSBURGH LOCK SEAMS, discloses a tool for folding sheet metal edges. A pneumatic hammer has a stepped barrel with an externally cylindrical proximal portion and a reduced-down distal portion externally formed with inverse spring thread. A plunger has a shank with a work-striking head, a spaced away butt end that loads into the hammer barrel, and an intermediate axial-stop enlargement disposed therebetween. A spring for retention of the plunger and has a main body formed on a major diameter, a shank-latching portion formed on a minor diameter, and a transition section therebetween. The main body has a series of closed regular coils which partly thread onto the inverse spring thread of hammer barrel and in other part which, with inclusion of the transition section, generally project so that the shank-latching portion latches across the shank of the plunger just forward of the axial stop. That way, axial extensions of the spring normally retract the plunger back into the hammer barrel. A rigid guide has a base end with a clamping mechanism for clamping onto the hammer barrel's proximal portion.

SUMMARY OF THE INVENTION

The present invention is a hand held device designed to open a longitudinal seam that is used in the fabrication of sheet metal ductwork. The tool hereof may be defined as a hand implement for applying a pulling force to disengage the lips on the walls of duct sections and is adapted for manual operation on the job. The tool is of small size, is light in weight, and is easily and readily operable in the hands of the workman.

The Pittsburgh lock opening tool of this invention has a unitary, longitudinal base having a major plane, an upper surface, and a lower surface. The base tapers from a proximal end to a distal end thereof. A plurality of longitudinal channels is oriented along the major plane on both upper and lower surfaces of the base. A protrusion is provided at the distal end of the base from its upper surface and extends perpendicularly to the major plane thereof. The protrusion is tapered upwardly to an uppermost end and away from the base. An inverted U-shaped terminus is disposed at the uppermost end of the protrusion and forms a sharp taper for penetrating between coacting duct components.

It is a primary object of the invention to providing a hand tool of the reverse bending type which is designed to engage the end edge or lip portion of a duct section wall and to bend it away from another duct section wall.

Another object of this invention is to provide a tool for turning edges on a piece of sheet metal in relatively inaccessible places.

A further object of this invention is to provide a tool for opening Pittsburgh locks.

A further object of this invention is to provide a tool for opening Pittsburgh locks which have been already assembled and where it is desired to disassemble said pieces of sheet metal by loosening and opening said locks.

It is another object of the invention to facilitate the disengaging of runs and fittings of the components of a duct system where same is being removed or replaced, all with a minimum of labor so as to reduce costs.

Another object of the present invention is to provide a sheet metal working tool for turning the edge of sheet metal so that said edge will be approximately 90 degrees to the plane of the main piece of metal.

It is yet another object of the invention to provide an easy and efficient method for opening this common seam during the duct assembly process.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

To the accomplishment of the foregoing and related ends, certain illustrative aspects are described herein in connection with the following description and the annexed drawings. These aspects are indicative of the various ways in which the principles disclosed herein can be practiced and all aspects and equivalents thereof are intended to be within the scope of the claimed subject matter. Other advantages and novel features will become apparent from the following detailed description when considered in conjunction with the drawings.

In accordance with the invention, the Pittsburgh lock opening tool has a unitary, longitudinal base having a major plane, an upper surface, and a lower surface. The base tapers from a proximal end to a distal end thereof. A protrusion is provided at the distal end of the base from its upper surface and extends perpendicularly to the major plane thereof. The protrusion is tapered upwardly to an uppermost end and away from the base. An inverted U-shaped terminus is disposed at the uppermost end of the protrusion and forms a sharp taper for penetrating between coacting duct components.

Figure 1:
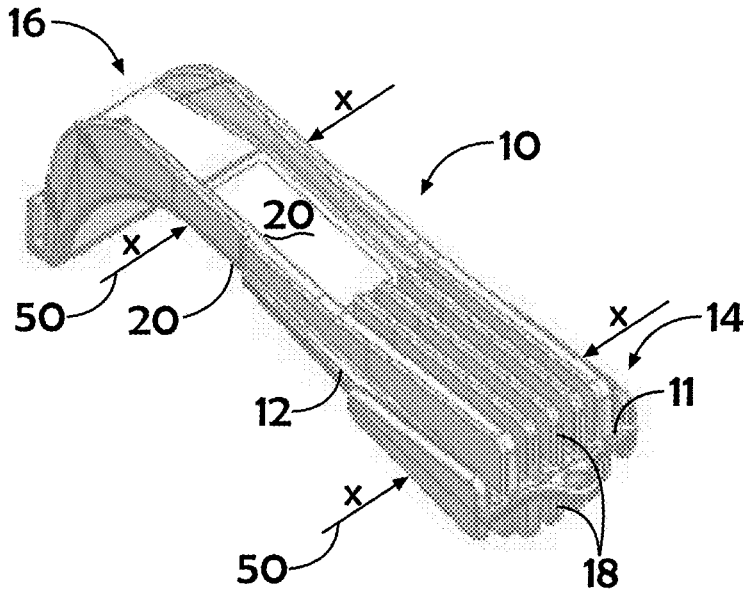
FIG. 1 is a perspective view of the Pittsburgh lock opening tool in accordance with the invention.

Referring now to FIG. 1, there is shown a perspective view of the Pittsburgh lock opening tool 10 in accordance with the invention. A longitudinal base 12 having a major plane, is high strength plastic, composite material, metal (e.g., ten gauge, flat, mild steel bar), or metal alloy and can be formed at one time in a manner well known in the art of plastic molding or metal extrusion. Base 12 is generally thicker at it proximal end 14, tapering to a thinner distal end 16. The longitudinal base 12 also has a horizontal dimension, arrows 50 and along lines X-X, that narrows from the proximal end 14 (approximately 1.6") to the distal end 16 thereof (approximately 1.0").

A plurality of parallel, longitudinal channels 18 is oriented along the major plane on the upper surface 20 and the lower surface 22 of the base 12. The channels 18 extend on the upper surface 20 of the base 12 from the proximal end 14 to a position short of the distal end 16 of the base 12.

Figure 2:
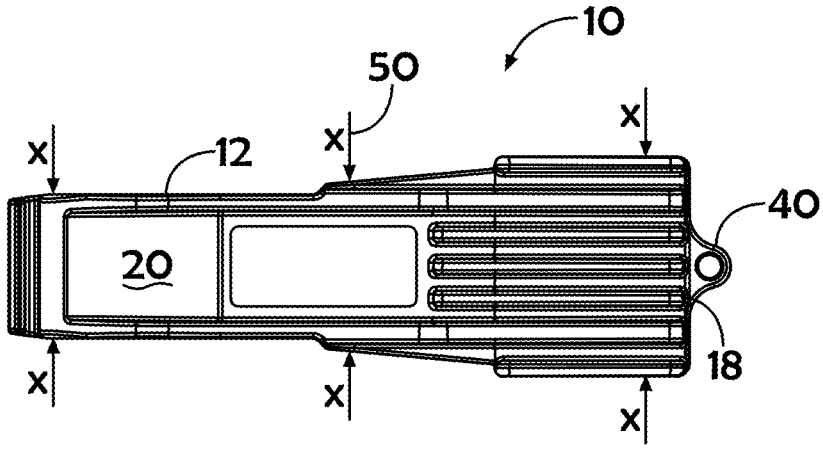
FIG. 2 is a plan view of the underside of the Pittsburgh lock opening tool shown in FIG. 1.

Referring now also to FIG. 2, the channels 18 extend partially along the lower surface 22 of the base 12 from the proximal end 14 thereof. A portion of the lower surface 22 of the base 12 proximate the distal end 16 thereof forms a cavity 23 for a user's fingers, not shown, during operation of the Pittsburgh lock opening tool 10.

Figure 3:
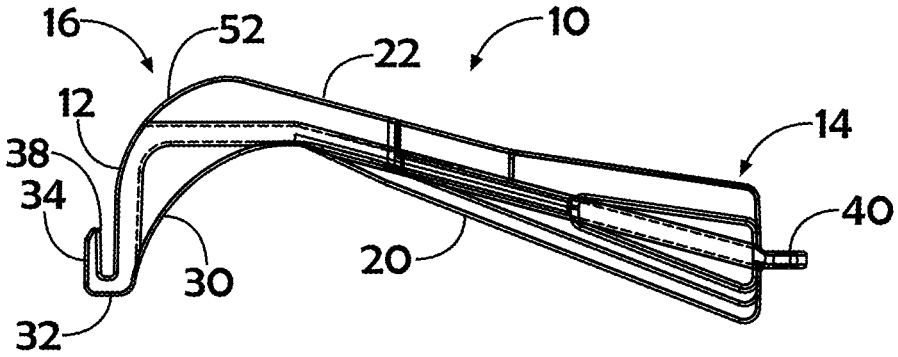
FIG. 3 is a cross sectional view of the Pittsburgh lock opening tool shown in FIGS. 1 and 2.

Referring now also to FIG. 3, a protrusion 30 is disposed at the distal end 16 of the base 12 and extends from the upper surface 20 thereof, substantially perpendicular to the major plane thereof. The protrusion 30 is tapered upwardly to an uppermost end 32 and away from the base 12. In the preferred embodiment, protrusion 30 stands approximately 1.0" high.

An inverted U-shaped terminus 34 is at the uppermost end 32 of the protrusion 30. The inverted U-shaped terminus 34 forms a sharp taper 38 for penetrating between coacting duct components, not shown. A portion 52 of the protrusion 30 attached to the distal end 16 of the base 12 is curved to form a fulcrum during operation of the Pittsburgh lock opening tool 10.

An eyelet 40 is optionally provided proximate the proximal end 14 of the base 12.

From the foregoing description, it can be see that the Pittsburgh lock opening tool 10 of this invention offers users a hand held device designed to open a longitudinal seam, not shown, during the assembly of sheet metal ductwork.

Since other modifications and changes varied to fit particular operating requirements and environments will be apparent to those skilled in the art, this invention is not considered limited to the example chosen for purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A Pittsburgh lock opening tool comprising:

a) a unitary, longitudinal base having a major plane, an upper surface, and a lower surface, said base tapering from a proximal end to a distal end thereof;

b) a protrusion disposed at said distal end of said base and extending from said upper surface thereof, substantially perpendicular to said major plane thereof, said protrusion being tapered upwardly to an uppermost end and away from said base, a portion of said protrusion attached to said distal end of said base being curved to form a fulcrum during operation of said Pittsburgh lock opening tool; and c) an inverted U-shaped terminus at said uppermost end of said protrusion.

2. The Pittsburgh lock opening tool in accordance with claim 1, wherein said inverted U-shaped terminus forms a sharp taper for penetrating between coacting duct components.

3. The Pittsburgh lock opening tool in accordance with claim 1, further comprising an eyelet proximate said proximal end of said base.

4. The Pittsburgh lock opening tool in accordance with claim 1, wherein said longitudinal base comprises a horizontal dimension narrowing from said proximal end to said distal end thereof.

5. The Pittsburgh lock opening tool in accordance with claim 1, further comprising:

d) a plurality of parallel, longitudinal channels oriented along said major plane on said upper surface and said lower surface of said base, said channels extending on said upper surface from said proximal end to a position short of said distal end of said base.

6. The Pittsburgh lock opening tool in accordance with claim 5, wherein said plurality of longitudinal channels on the lower surface of said base extends partially along said lower surface from said proximal end of said base.

7. The Pittsburgh lock opening tool in accordance with claim 5, wherein a portion of said lower surface of said base proximate said distal end thereof comprises a cavity for a user's fingers during operation of said Pittsburgh lock opening tool.

8. The Pittsburgh lock opening tool in accordance with claim 1, wherein said Pittsburgh lock opening tool comprises at least one of the materials: plastic, composite material, metal, and metal alloy.

9. A Pittsburgh lock opening tool comprising:

a) a unitary, longitudinal base tapering from a proximal end to a distal end thereof, and having a plurality of parallel, longitudinal channels oriented therealong;

b) a protrusion disposed at said distal end of said base and extending substantially perpendicular thereof, said protrusion being tapered upwardly to an uppermost end and away from said base; and c) an inverted U-shaped terminus at said uppermost end of said protrusion.

10. The Pittsburgh lock opening tool in accordance with claim 9, wherein said inverted U-shaped terminus forms a sharp taper for penetrating between coacting duct components.

11. The Pittsburgh lock opening tool in accordance with claim 9, further comprising an eyelet proximate said proximal end of said base.

12. The Pittsburgh lock opening tool in accordance with claim 9, wherein said longitudinal base comprises a horizontal dimension narrowing from said proximal end to said distal end thereof.

13. The Pittsburgh lock opening tool in accordance with claim 9, wherein said plurality of longitudinal channels on at least a portion of said base extends only partially along said base from said proximal end of said base.

14. The Pittsburgh lock opening tool in accordance with claim 9, wherein a portion of said base proximate said distal end thereof comprises a cavity for a user's fingers during operation of said Pittsburgh lock opening tool.

15. The Pittsburgh lock opening tool in accordance with claim 9, wherein said Pittsburgh lock opening tool comprises at least one of the materials: plastic, composite material, metal, and metal alloy.

16. The Pittsburgh lock opening tool in accordance with claim 9, wherein a portion of said protrusion attached to said distal end of said base is curved to form a fulcrum during operation of said Pittsburgh lock opening tool.

* * * * *